United States Patent [19]

Korenev et al.

[11] 4,249,703

[45] Feb. 10, 1981

[54] APPARATUS FOR MECHANICAL AND CHEMICAL DESTRUCTION OF POLYSACCHARIDES OF YOUNGER SLIGHTLY DECOMPOSED PEAT

[76] Inventors: Vladimir P. Korenev, ulitsa Akademika Kurchatova, 13, kv. 59, Irkutsk; Jury S. Ippolitov, ulitsa Lapina, 9, kv. 10, Irkutsk; Boris P. Belyaev, ulitsa Lapina, 9, kv. 6, Irkutsk; Arvid Y. Kalninsh, ulitsa Sverdlova, 8, kv. 3, Riga; Nikolai A. Vedernikov, ulitsa Aptiekas, 8, kv. 66, Riga; Valter P. Krastinsh, ulitsa Sabiles, 11, kv. 12, Riga; Guntis K. Abolinsh, poselok Salaspils, ulitsa Miera, 16/7, Rizhsky raion; Karl M. Abele, ulitsa Michurina, 22, kv. 12, Riga; Felix A. Ekis, ulitsa Suvorova, 131, kv. 4, Riga, all of U.S.S.R.

[21] Appl. No.: 961,103

[22] Filed: Nov. 16, 1978

Related U.S. Application Data

[63] Continuation of Ser. No. 806,553, Jun. 14, 1977, abandoned.

[51] Int. Cl.[3] ..... B02C 7/14

[52] U.S. Cl. ..... 241/247; 241/259.1; 241/261.1

[58] Field of Search ..... 241/247, 259.1, 259.3, 241/261, 261.1

[56] References Cited

U.S. PATENT DOCUMENTS

| | | | |
|---|---|---|---|
| 1,780,067 | 10/1930 | Cox | 241/247 X |
| 2,674,163 | 4/1954 | Prevost | 241/259.3 |
| 3,514,079 | 5/1970 | Little, Jr. | 241/261.1 X |
| 3,788,567 | 1/1974 | Yamada | 241/261.1 X |
| 4,008,858 | 2/1977 | Yamada et al. | 241/261.1 X |

*Primary Examiner*—Howard N. Goldberg

*Attorney, Agent, or Firm*—Robert E. Burns; Emmanuel J. Lobato; Bruce L. Adams

[57] ABSTRACT

An apparatus comprises a cylindrical casing having a pipe for admitting starting material. An auger feeder is accommodated in the casing having a working head and a nozzle having a central passage for feeding out hydrolysate mass. The nozzle is connected to the casing and is mounted coaxially with and in a radially spaced relation to the head. The working head comprises two truncated cones interconnected at larger bases thereof and is rigidly secured to the auger feeder. The central passage of the nozzle is made narrowing towards the outlet and embraces the second truncated cone of the head in the path of flow of the starting material.

4 Claims, 4 Drawing Figures

APPARATUS FOR MECHANICAL AND CHEMICAL DESTRUCTION OF POLYSACCHARIDES OF YOUNGER SLIGHTLY DECOMPOSED PEAT

This is a continuation of application Ser. No. 806,553, filed 6/14/77, now abandoned.

BACKGROUND OF THE INVENTION

The present invention relates to the equipment for hydrolysis of peat, and more particularly to apparatus for mechanical and chemical destruction of polysaccharides of younger slightly decomposed peat.

The invention may be advantageously used in the microbiological industry for producing culture medium for cultivation of fodder yeast or as stimulator of growth of fodder yeast cultivated on culture media obtained by hydrolysis of wood or agricultural wastes.

The increasing rate of agricultural development creates an evergrowing demand for valuable vitamin-protein fodder products, such as fodder yeast to be used in animal breeding.

At present, fodder yeast is produced on the basis of hydrolysis of wood, agricultural wastes, such as maiz strimps, rice seed husk, cotton husk, straw and the like, and on the basis of processing of products of the petrochemical industry. The above-mentioned starting materials cannot satisfy the demand of the national economy in vitamin-protein fodder products, and the problem resides in finding new kinds of non-food starting materials suitable for processing into protein fodder, such as fodder yeast.

In finding a solution to this problem, the possibility of and promising results from processing a new starting material—younger slightly decomposed peat—into fodder yeast has been revealed, the new starting material being largely available and practically unused.

In view of specific physical and chemical properties of peat, it is economically inadvantageous to produce therefrom hydrolysate in the form of a solution of a mixture of sugars which constitutes a culture medium for cultivation of yeast by using conventional methods of hydrolysis in autoclaves/hydrolizers.

The attempts to make the use of younger peat economically advantageous for hydrolysis resulted in the provision of equipment in which a hydrolysate mass containing a mixture of water-soluble sugars is obtained by means of mechanical and chemical treatment of slightly decomposed peat in the presence of small quantities of concentrated sulphuric acid.

The mechanical and chemical treatment of peat is effected in an apparatus for a certain time and within a limited space in which the material being treated is subjected to mechanical action resulting in great shearing forces inside the peat particles, the attrition effect of such forces providing for breaking of chemical bonds in molecular chains, that is destruction of polysaccharides of peat occurs with the formation of homogeneous hydrolysate mass containing monosugars. Subsequent processing of hydrolysate mass containing a mixture of non-dissolved sugars results in obtaining hydrolysate, that is a solution of mixture of sugars, which is used as culture medium for cultivation of fodder yeast or as stimulator of growth of fodder yeast cultivated on culture media obtained by hydrolysis of wood or agricultural wastes.

Known in the art is an apparatus for comminution and mixing of solid substances inpregnated with liquid, such as peat.

The apparatus comprises a cylindrical casing having a vertical admission pipe and a horizontal outlet pipe tangent to the casing. A disintegrating rotor is accommodated within the casing at the outlet side thereof and consists of an inclined disc having peripheral teeth. The teeth cooperate with grooves made in the inner wall of the casing. An auger is mounted in the casing coaxially with the rotor, the end of the auger which faces the outlet is spaced apart from the disc rotor to define a working space. The rotor and auger are rotated independently on each other by means of individual drives.

The apparatus functions in the following manner.

Lump peat or other material is fed via an admission pipe or conduit into the casing where it is engaged by the auger to be displaced to meet the rapidly rotating disintegrating disc rotor.

The material is accumulated in the working space between the auger and the rotor to form a plug which is pushed through by the auger to be comminuted by the disc rotor due to the presence of teeth on the periphery of the disc and grooves of the casing, as well as due to the inclined position of the disc. The comminuted material is thrown by centrifugal force through the outlet pipe.

This apparatus cannot, however, be used for mechanical and chemical destruction of polysaccharides of peat because the construction of the apparatus cannot provide conditions required for the purpose.

The material within the working space between the auger and the disc rotor fills the entire cross-section of the cylinder to form a plug which is shorn off the end face in layers so that the material is comminuted.

In shearing any material, shear forces are developed, but such forces cannot bring about the attrition action between the particles of material because the contact of the working tool with the material occurs along a line or along a surface, rather than within a three-dimensional space.

It should be noted that the main requirement for mechanical and chemical destruction of polysaccharides of peat with considerable shearing forces is the provision of an attrition action occurring both in time and space which is necessary for breaking chemical bonds of molecular chains.

Another apparatus is known in the art for mechanical and chemical destruction of polysaccharides of younger slightly decomposed peat.

This apparatus comprises a casing accommodating an auger and a working head which are mounted axially thereof and rotated by means of individual drives. A nozzle is mounted in the casing coaxially with the head, the nozzle embracing the head and defining an annular space with the head which forms a working space for effecting mechanical and chemical destruction of polysaccharides of peat. A spring-loaded stop is mounted on the same shaft with the head, at the side of outlet of hydrolysate mass, the stop being axially displaceable during the operation to provide back pressure.

The spring-loaded stop which is axially displaceable during operation, in cooperation with the auger, results in impulse feeding of a hydrolysate mass through the working space.

Changes in moisture content of the peat, its grading and the like, result in impulse reciprocations of the spring-loaded stop and in changes in back pressure within the working zone, hence in impulses outlet of the hydrolysate mass.

As a result of pulsation, the residence time of a mixture of peat and acid being treated in the working zone varies thus resulting in non-uniform destruction of polysaccharides, that is certain molecular chains are destroyed and others are not so that the hydrolysate mass thus obtained has a lower content of reducing substances, namely monosugars, the starting material is not completely utilized as regards sugars present therein, hence the apparatus has a low yield of finished product.

The use of two individual drives for destruction of polysaccharides in this apparatus results in high consumption of power.

In using the known apparatus on a large industrial scale, great quantities of starting material are processed due to the low yield of finished product, and a part of the starting material which does not undergo destruction is removed from further processing conducted for the production of fodder yeast.

SUMMARY OF THE INVENTION

It is an object of the invention to provide an apparatus ensuring a high yield of the finished product.

Another object of the invention is to improve the productivity of the apparatus in terms of the starting material used.

Still another object of the invention is to reduce the power requirement per unit of finished product.

Finally, it is an object of the invention to simplify the construction of the apparatus.

With these and other objects in view, the invention consists in that in an apparatus for mechanical and chemical destruction of polysaccharides of younger slightly decomposed peat comprises a cylindrical casing having a pipe for admitting starting material. An auger feeder with a working head is accommodated in the casing and a nozzle having a central passage for outlet of the hydrolysate mass connected to the casing. The nozzle is mounted coaxially with and in a radially spaced relation to the head and embraces it. According to the invention, the working head comprises two truncated cones interconnected at their larger bases and is rigidly secured to the auger, and the central passage of the nozzle is made narrowing towards the outlet of the product and embraces the second cone of the head in the path of flow of the starting material.

This apparatus for hydrolysis of peat has an improved productivity due to elimination of pulsations at the outlet of the hydrolysate mass and increased mechanical action on the starting material being processed.

The head and nozzle define a constant radial space therebetween so that a constant back pressure required for destruction of polysaccharides is ensured, whereby a constant residence time of the mixture being processed in the working zone—the space between the working head, casing and nozzle—is insured which results in uniform destruction of polysaccharides, that is molecular chains are broken uniformly. This results in an improved yield of reducing substances, that is sugars per unit of weight of the starting material being processed. Therefore, the starting material is utilized more completely in terms of finished product because smaller quantity of starting material need be consumed per unit of weight of finished product, or vice versa, more finished product—sugar—can be obtained per unit of weight of starting material.

The head comprising two truncated cones provides for increased mechanical action on the material being processed since the process of destruction of polysaccharides in the working zone of the head proceeds in two stages in this case. Starting material, that is a mixture of peat and concentrated acid is fed by means of the auger feeder to the working zone. In the presence of a constant back pressure created due to a constant radial space defined between the head and the nozzle, the mixture admitted to the zone formed by the first cone of the head in the path of flow of starting material and the casing, is compressed, heated due to friction and partially ground. Thus, a partial destruction of the polysaccharides occurs. Final destruction of polysaccharides of peat takes place in the radial working space between the second truncated cone of the head in the path of flow of starting material and the nozzle where great shearing forces are created within peat particles, the attrition action of these forces provides for breaking of the chemical bonds of the molecular chains.

In addition, rigid connection of the working head directly to the auger results in that power requirement is 30% lower and simplifies the construction of the apparatus because there is no drive for the head.

The central passage of the nozzle preferably comprises different diameter portions thus increasing the mechanical action on the material being processed.

The material being processed flows through the working space to fill up corner portions of the stepped opening. Thus internal friction within the material being processed is much greater than that between the material being processed and the metal of the apparatus so that the attrition action within particles increases, and destruction is effected more completely resulting in improved productivity of the apparatus in terms of the finished product.

The central passage of the nozzle may be tapered which is much easier to manufacture and hence cheaper. In this case, during the flow of material through the working space, friction occurs between the material being processed and the metal of the working zone, and this friction is lower than internal friction within the material, as described, an in the central passage of the nozzle comprising of different diameter portions. Therefore, to obtain the same result as with the nozzle having the stepped passage, the radial space between the head and the nozzle should be reduced by 20–30%.

The nozzle is preferably axially displaceable for adjustment of the radial space upon changes in moisture content of the starting material. Upon changes in moisture content of the starting material, the content of sulphuric acid in the mixture varies thus requiring inevitable variation of the residence time of the material being processed in the working zone and working space for complete destruction of polysaccharides of peat. The residence time may be varied by changing the back pressure at the outlet of the hydrolysate mass by adjusting the radial space between the head and nozzle. This is achieved by providing for axial displacement of the nozzle. The nozzle is fixed in the casing during processing.

The first cone of the head in the path of the flow of starting material is preferably provided with ribs. This construction of the head results in increased mechanical action on the material being processed because the shearing forces within the particles increase due to intensive stirring, and as described above, this results in improved productivity of the apparatus in terms of finished product, that is in greater content of sugars in the resultant hydrolysate mass.

The ribs preferably extend at an angle from 15° to 20° to the axis of the truncated cone so that the inclination of the ribs coincides with the direction of the helical line of the auger.

This construction of the head, in addition to an increase in shearing forces, hence an improvement of productivity of the apparatus in terms of finished product, improves the productivity of the apparatus in terms of starting material since the inclined ribs constitute a continuation of the auger turns but with a different pitch and, in addition to more intensive stirring, they push the material through forwardly.

The head is journalled at the side of the outlet of finished product by means of an intermediate member in a bearing mounted outside the casing. This arrangement of the head improves rigidity of construction, eliminates vibrations, hence improves the reliability of the apparatus as a whole.

The apparatus according to the invention has for example, an auger 190 mm in diameter with a pitch of helical line of 192 mm with rotational speed of 180 rpm had a productivity of 1.0 ton of hydrolysate mass per hour containing 70–73% of polysaccharides from theoretic content of the starting peat when processing a mixture of peat having a moisture content below 20–25% and a degree of decomposition below 20% and 92.5% sulphuric acid used in the amount corresponding to the weight ratio of acid monohydrate to absolutely dry peat of 0.15.

BRIEF DESCRIPTION OF THE DRAWINGS

Other objects and advantages of the invention will be apparent from the following embodiments thereof illustrated in the accompanying drawings, in which.

DESCRIPTION OF THE PREFERRED EMBODIMENTS

Figure 1:
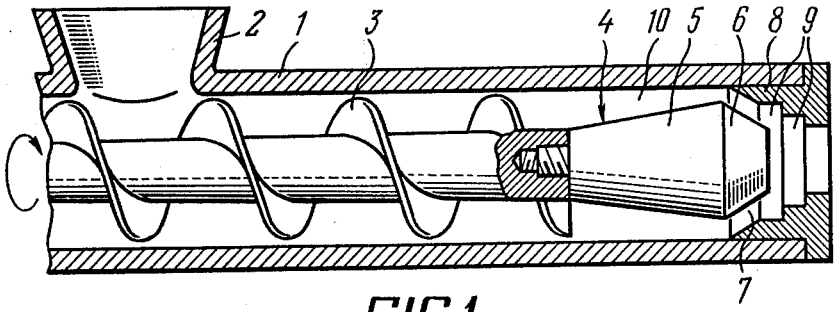
FIG. 1 is a fragmentary longitudinal section view of an apparatus for mechanical and chemical destruction of polysaccharides of younger slightly decomposed peat having a nozzle with a central passage comprising different diameter portions.

The apparatus for mechanical and chemical destruction of polysaccharides of younger slightly decomposed peat comprises a cylindrical casing 1 (FIG. 1) having a pipe or inlet 2 for admission of a mixture of younger slightly decomposed peat and concentrated sulphuric acid. The casing 1 accommodates an auger feeder 3 having a working head 4 rigidly secured thereto. The working head 4 comprises two truncated cones 5 and 6 interconnected at their larger bases. A nozzle 8 is mounted coaxially with the working head 4 to define a radial space 7 therewith, the nozzle embracing the second cone 6 of the working head 4 in the path of flow of the starting material and is connected to the casing 1. A central passage 9 of the nozzle 8 comprises different diameter portions and narrows towards the outlet of the hydrolysate mass. The space defined by the cone 5 of the head 4 and the casing 1 forms a working zone 10.

The apparatus functions in the following manner. Starting material—a mixture of younger slightly decomposed peat and concentrated sulphuric acid—is fed through the admission pipe 2 to the casing 1. The mixture is fed by the auger feeder 3 to the working zone 10 and working space 7. Due to a constant volume of the radial space 7, a required back pressure is provided by decreasing cross-sectional area at the outlet of hydrolysate mass from the nozzle 8. Due to this back pressure, the mixture entering the working zone 10 is compressed, heated due to friction and partially ground. Thus, due to increased mechanical action of the material being processed, a partial destruction of the polysaccharides of peat takes place. Final destruction of the polysaccharides is effected in the radial working space 7 where great shearing forces are developed within the peat particles, the attrition action of these forces provides for breaking of the chemical bonds of the molecular chains.

Constant required back pressure created by means of the fixed nozzle 8 provides for a pre-set residence time of the material being treated in the working zone 10 and a working space 7 and a uniform process of mechanical and chemical destruction of the polysaccharides of peat to produce a homogeneous hydrolysate mass. As a result of the uniform destruction of the polysaccharides and increased mechanical action on the material being processed, the percentage of monosugars in the hydrolysate mass increases, starting material is utilized more completely, and the productivity of the apparatus in terms of the finished product is improved.

Rigid connection of the working head 4 directly to the auger feeder 3 results in lowering power consumption by 30% and a simplified structure.

The provision of the stepped central passage 9 of the nozzle 8 which narrows towards the outlet of the product increases mechanical action on the material being processed, the material filling up corner portions of the passage, friction within the material is developed which is greater than that between the material and metal of the casing. Due to the increased friction, the back pressure in the working space 7 increases thus resulting in a more complete destruction of polysaccharides, hence in improved productivity of the apparatus in terms of finished product.

The central passage 11 (FIG. 2) of the nozzle 8 narrowing towards the outlet of the product may be tapered which is much simpler in the manufacture.

In this case, friction during the flow of material through the working space occurs between the material and metal, and this friction is lower than that within the material as was the case with the nozzle 8 having the central passage 9 comprising different diameter portions. Therefore, in order to achieve the same result as with the nozzle 8 having the stepped central passage 9, the radial space 7 between the head and the nozzle is to be 25–30% smaller.

Figure 2:
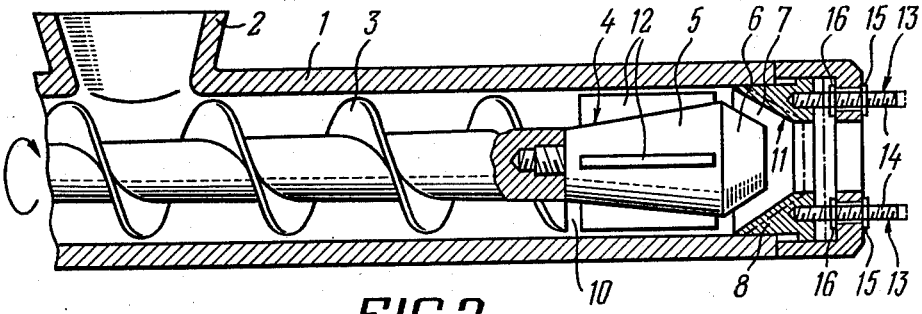
FIG. 2 is a fragmentary sectional view of an embodiment of an apparatus for mechanical and chemical destruction of polysaccharides of younger slightly decomposed peat in which the nozzle has a tapered central passage and is axially displaceable for adjustment of the radial space upon changes in moisture content of starting material, and the first truncated cone of the head in the path of flow of starting material is provided with ribs.

FIG. 2 shows a construction of the apparatus which is more preferable than that described above.

In order to increase the mechanical action on the material being processed, the first truncated cone 5 of the head 4 in the path of flow of the starting material is provided with ribs 12. Intensive stirring of the mass by the ribs 12 in the working zone 10 provides for increased shearing forces within peat particles thus resulting in improved productivity of the apparatus in terms of the finished product.

The nozzle 8 is axially displaceable, e.g. by means of screw devices or mechanisms 13 comprising studs 14 threaded into the nozzle 8 and passing freely through the end face of the casing 1, and two nuts 15 and 16 for adjusting the radial space 7 upon changes in moisture content of the starting material. Changes in the moisture content of the starting material result in changes in the content of acid in the mixture so that the residence time of the starting material being processed in the working zone 10 and working space 7 is to be varied for complete destruction of the polysaccharides. This time may be varied by changing the back pressure at the outlet of the hydrolysate mass by changing the volume of the radial working space 7.

The radial working space 7 is adjusted in the following manner. Where it is necessary to increase the space 7, the nuts 15, 16 are driven along the studs 14 towards the nozzle 8. The movement of the nuts 15 and 16 in one direction along the studs 14 threaded in the nozzle 8 causes the nozzle to move towards the outlet of the hydrolysate mass thereby increasing the volume of the radial space 7. The space is reduced by moving the nuts 15 and 16 along the studs 14 in the opposite direction. During the processing, the nozzle 8 is fixed in the casing by means of the same screw mechanisms 13.

In order to improve the productivity of the apparatus in terms of starting material, along with the productivity in terms of the finished product, the ribs 12 (FIGS. 3,4) are arranged on the first truncated cone 5 of the head 4 in the path of flow of starting material at an angle from 15° to 20° to the axis in such a manner than their inclination coincides with the direction of the helical line of the auger. This construction results in improved productivity in terms of the starting material since the inclined ribs constitute a continuation of the auger turns having a different pitch and, apart from intensive stirring, they push through the material being processed forwardly.

Figure 3:
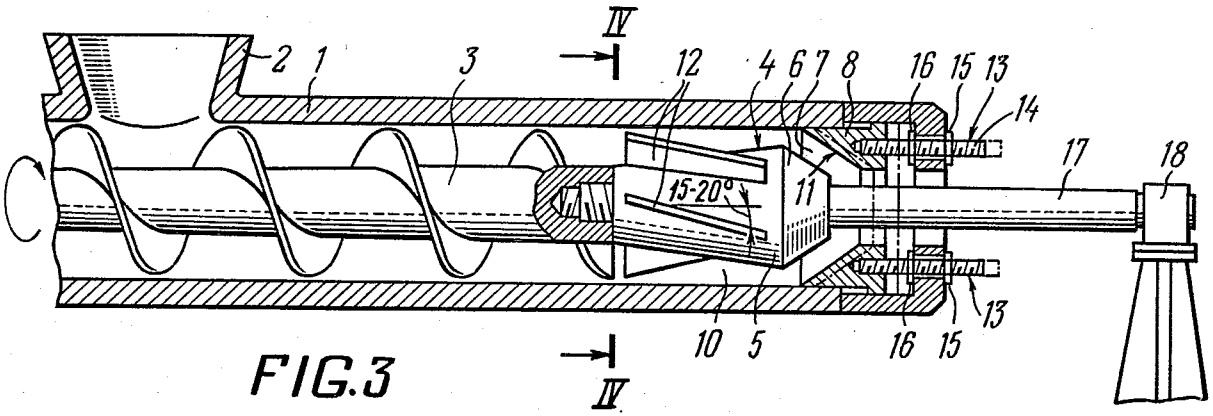
FIG. 3 is a fragmentary sectional view of an embodiment of an apparatus for mechanical and chemical destruction of polysaccharides of younger slightly decomposed peat in which the nozzle has a tapered central passage and is axially displaceable for adjustment of the radial space upon changes in moisture content of starting material, the ribs of the first truncated cone of the head in the path of flow of starting material extend at an angle from 15° to 20° to the axis so that their inclination coincides with the direction of the helical line of the auger, and the head is journalled on the side of the outlet of hydrolysate mass by means of an intermediate member in a bearing mounted outside the casing.
Figure 4:
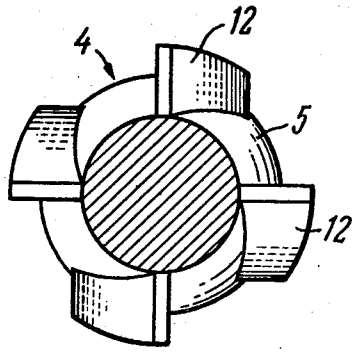
FIG. 4 is a sectional view taken along the line IV—IV across the head in FIG. 3.

FIG. 3 also shows the working head 4 which is journalled on the side of the outlet of the hydrolysate mass by means of an intermediate member 17 in a bearing 18 which is mounted outside the casing.

During operation of the apparatus, great forces are developed in the working zone 10 and the radial space 7 which not only act on the material being processed but also on the head 4 secured to the auger 3. These forces result in lateral deformations of the head 4 and auger 3 leading to vibrations.

The installation of the head 4 by means of the intermediate member 17 in the bearing 18 increases the rigidity of construction, eliminates vibrations, hence improves the reliability of the apparatus as a whole.

What is claimed is:

1. Apparatus for mechanical and chemical destruction of polysaccharides of younger slightly decomposed peat comprising, a tubular casing of constant inner diameter, a driven auger feeder in said casing for conveying starting material axially along the casing, means defining an inlet for introducing starting material into said casing, a nozzle having a central passage in communication with said casing and defining an outlet from said tubular casing axially spaced from said inlet, a working head on an end of said auger feeder and rotationally driven thereby, said working head comprising two frustoconical cones connected along larger bases thereof, a first of said frusto-conical cones having a taper and progressively increasing in diameter in a direction of material flow in said casing toward said outlet and defining with inner cylindrical surfaces of constant diameter of the tubular casing a working annular space gradually decreasing axially in cross section within which material being treated in said casing is progressively compressed, mixed and treated, a second of said frusto-conical cones having a shorter axial length than said first cone and tapering toward the axis of said auger feeder and in a direction toward said outlet, said nozzle having an internal tapered passage having a converging portion at least partially circumferentially of said second cone spaced therefrom and having a taper corresponding to the taper of said second cone and defining with said second cone a working zone a desired volume of uniform cross section in which mechanical and chemical destruction of polysaccharides in said material takes place to yield a homogeneous hydrolysate.

2. Apparatus for mechanical and chemical destruction of polysaccharides of younger slightly decomposed peat according to claim 1, in which said first cone has axial ribs circumferentially spaced thereon, said ribs being inclined relative to the longitudinal axis of said casing and working head, and the ribs having a greater inclination in a direction toward said inlet.

3. Apparatus according to claim 2, in which said inclination is in the order of 15° to 20° relative to said longitudinal axis.

4. Apparatus according to claim 1, in which said nozzle is movable axially relative to said second cone on said working head.

* * * * *